US008512927B2

(12) United States Patent
Iizuka et al.

(10) Patent No.: US 8,512,927 B2
(45) Date of Patent: Aug. 20, 2013

(54) ELECTROSTATIC IMAGE DEVELOPING CARRIER, ELECTROSTATIC IMAGE DEVELOPING DEVELOPER, ELECTROSTATIC IMAGE DEVELOPING DEVELOPER CARTRIDGE, PROCESS CARTRIDGE, AND IMAGE FORMING APPARATUS

(75) Inventors: Akihiro Iizuka, Kanagawa (JP); Fusako Kiyono, Kanagawa (JP); Tsuyoshi Murakami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 984 days.

(21) Appl. No.: 11/730,899

(22) Filed: Apr. 4, 2007

(65) Prior Publication Data

US 2008/0056769 A1 Mar. 6, 2008

(30) Foreign Application Priority Data

Sep. 4, 2006 (JP) ..... 2006-239311

(51) Int. Cl.
*G03G 9/00* (2006.01)

(52) U.S. Cl.
USPC ..... 430/111.35; 430/111.1; 430/111.41; 430/108.1; 430/137.1

(58) Field of Classification Search
USPC ..... 430/108, 106.6, 137, 111.41, 108.1, 430/106.1, 137.1, 111.1, 111.35
See application file for complete search history.

(56) References Cited

U.S. PATENT DOCUMENTS

| | | | | |
|---|---|---|---|---|
| 4,048,136 | A * | 9/1977 | Kobayashi et al. | 524/439 |
| 5,631,116 | A * | 5/1997 | Uchida et al. | 430/111.1 |
| 5,643,704 | A | 7/1997 | Tamura et al. | |
| 5,750,313 | A * | 5/1998 | Tamada et al. | 430/280.1 |
| 6,251,554 | B1 * | 6/2001 | Hoffend et al. | 430/111.1 |
| 2004/0106058 | A1 * | 6/2004 | Itoh | 430/110.2 |
| 2006/0140664 | A1 | 6/2006 | Takami | |

FOREIGN PATENT DOCUMENTS

| | | |
|---|---|---|
| JP | A 59-104664 | 6/1984 |
| JP | B2 2-21591 | 5/1990 |
| JP | A 7-114219 | 5/1995 |
| JP | A-8-62902 | 3/1996 |
| JP | A 9-269614 | 10/1997 |
| JP | A-2003-248343 | 9/2003 |

OTHER PUBLICATIONS

Nov. 16, 2010 Japanese Office Action issued in Japanese Patent Application No. 2006-239311 (with translation).

* cited by examiner

*Primary Examiner* — Thorl Chea
(74) *Attorney, Agent, or Firm* — Oliff & Berridge, PLC

(57) ABSTRACT

An electrostatic image developing carrier including at least a core material and a coating resin layer which coats the surface of the core material, the resin layer comprising a thermoplastic resin having an alicyclic group, a thermal reduction in accordance with the TGA method being in the range of 0.5 weight % to 5 weight % of the whole of the carrier in the range of 100° C. to 400° C., and further an endothermic quantity of the whole of the carrier in accordance with the DTA method is in the range of 7 mJ/g to 40 mJ/g in the range of 100° C. to 400° C.

13 Claims, 3 Drawing Sheets

ELECTROSTATIC IMAGE DEVELOPING CARRIER, ELECTROSTATIC IMAGE DEVELOPING DEVELOPER, ELECTROSTATIC IMAGE DEVELOPING DEVELOPER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2006-239311 filed on Sep. 4, 2006.

BACKGROUND

1. Technical Field

The present invention relates to an electrostatic image developing carrier, an electrostatic image developing developer using the same, an electrostatic image developing developer cartridge using the electrostatic image developing developer, a process cartridge, and an image forming apparatus.

2. Related Art

At present, methods of forming an electrostatic latent image and then visualizing the latent image into image information, such as electrophotography, are used in various fields. In electrophotography, an electrostatic latent image is formed on a photoreceptor in a charging step and a light-exposing step, the electrostatic latent image is developed with a developer containing a toner, and then the image is made visible via a transferring step and a fixing step.

The developer used in this case is a two-component developer composed of a toner and a carrier, or a one-component developer made only of a toner, such as a magnetic toner. Out of the two developers, the two-component developer has widely been used in recent years because, as the carrier partially carries out the functions of stirring, transportation and charging of the developer component, the functions of the developer are separated into two components; consequently the developer has good controllability and other characteristics. In particular, a developer wherein a carrier comprising a core material and a resin for coating the core material (a resin-coated carrier) is used has improved charging controllability, and its dependency on its environment can be reduced with relative ease.

SUMMARY

According to an aspect of the present invention, there is provided an electrostatic image developing carrier comprising at least a core material and a coating resin layer which coats the surface of the core material, the resin layer comprising a thermoplastic resin having an alicyclic group, a thermal reduction of the carrier in accordance with the TGA method being in the range of 0.5 weight % to 5 weight % of the whole of the carrier in the range of 100° C. to 400° C., and further an endothermic quantity of the whole of the carrier in accordance with the DTA method being in the range of 7 mJ/g to 40 mJ/g or less in the range of 100° C. to 400° C.

BRIEF DESCRIPTION OF THE DRAWINGS

Exemplary embodiments of the present invention will be described in detail based on the following figures, wherein.

DETAILED DESCRIPTION (Electrostatic Image Developing Carrier)

Figure 1:
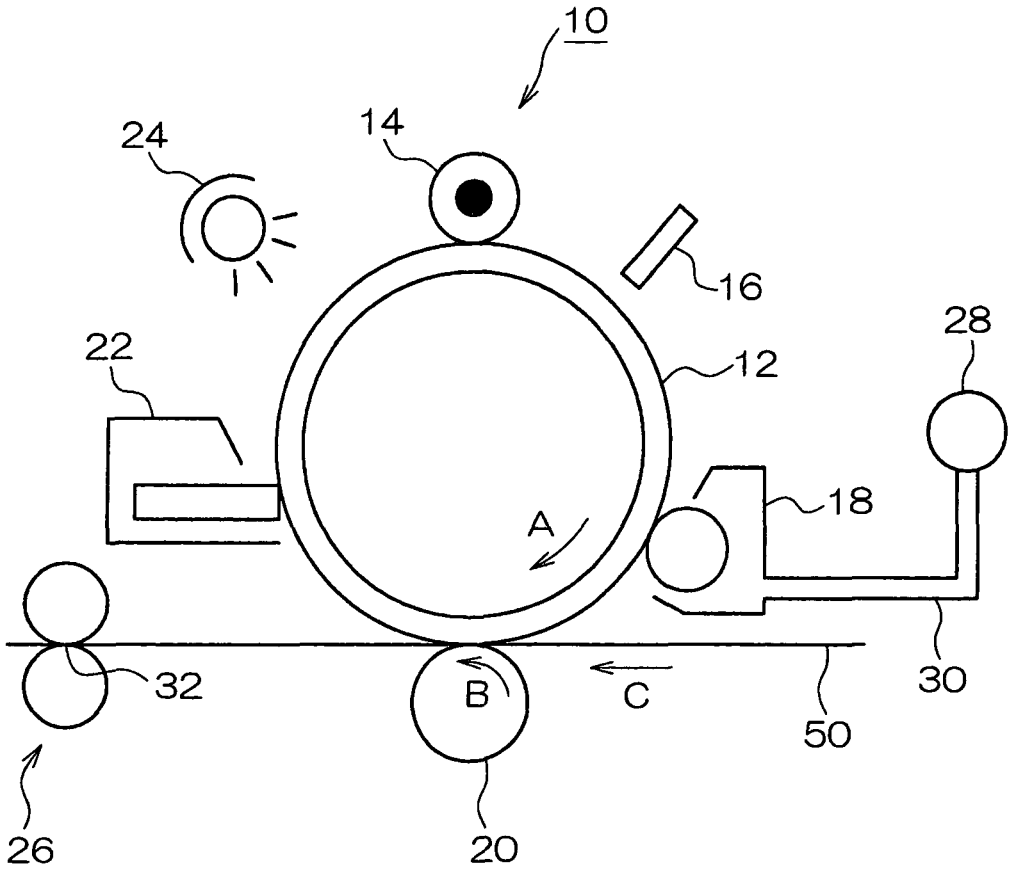
FIG. 1 is a sectional view which schematically illustrates a preferred embodiment (first embodiment) of the image forming apparatus of the invention.

The electrostatic image developing carrier of the present invention, which may be referred to as the "carrier" hereinafter, is a carrier comprising a core material and a coating resin layer which coats the surface of the core material and comprises a thermoplastic resin having an alicyclic group, wherein a thermal reduction in accordance with the TGA method is in the range of 0.5 weight % to 5 weight % of the whole of the carrier in the range of 100° C. to 400° C., and further the endothermic quantity of the whole of the carrier in accordance with the DTA method is in the range of 7 mJ/g to 40 mJ/g in the range of 100° C. to 400° C.

Due to this structure, the carrier of the invention has only a small dependency on environmental factors such as temperature and humidity, and does not cause the coating resin layer to peel off easily, and images can be formed stably over a long term. The reason for this is as follows:

In any two-component developer, electric charges are generated on the surface of its toner and the surface of its carrier by frictional charging of the toner and the carrier. Since the toner has a high insulation, the toner can hold the generated charges even at high temperature and high humidity. However, the carrier is controlled to have a semiconductive resistance to give a high image quality; therefore, the charges generated in the carrier surface leak easily at high temperature and high humidity. For this reason, preventing leakage of generated charges maintains the quantity of the charge at high temperature and high humidity, that is, it reduces the dependency of the carrier on its environment.

The leakage of the charges at high temperature and high humidity is thought to be caused by a coating resin layer on the carrier surface adsorbing moisture in the environment so that the generated charges are discharged in the air through the adsorbed moisture. In particular, in the carrier of a type in which electroconductive powder is added to the coating resin layer to adjust the resistance, the charge leakage is more easily caused. In the case of combining the carrier with a toner containing a crystalline resin to prepare a developer, it is further necessary to restrain charge leakage as described above since the quantity of charges generated from the toner becomes smaller.

Thus, the inventors have found out that in order not to cause the coating resin layer surface to adsorb moisture easily, it is very effective to use a "thermoplastic resin having an alicyclic group" in the coating resin layer.

However, in the case of forming images repeatedly over a long term, the developer continues to be stirred in a developing device; therefore, the thermoplastic resin, which has an alicyclic group, comes to be peeled from the carrier surface since the resin is not large in adhesive force to the surface of the core material.

Thus, the inventors have made eager investigations to restrain a coating resin layer from being peeled from a core material by long-term stirring in a developing device even in the case of using, for the coating resin layer, a thermoplastic resin having an alicyclic group, which is not very large in adhesive force to particles of the core material. As a result, it has been found out that it is important that the thermal reduction in accordance with the TGA method is in the range of 0.5 weight % to 5 weight % of the whole of a carrier in the range of 100° C. to 400° C., and further the endothermic quantity of the whole of the carrier in accordance with the DTA method is in the range of 7 mJ/g to 40 mJ/g in the range of 100° C. to 400° C.

This is because the following can be considered: when the thermal reduction of the carrier is in the above-mentioned range and further the endothermic quantity is in the above-mentioned range, the adhesive force of the thermoplastic resin, which has an alicyclic group, to the core material can be improved by controlling the orientation of the alicyclic groups of the thermoplastic resin. The reason therefor is as follows:

In the case that in the production of a carrier, the surfaces of core material particles are coated with a resin to form a coating resin layer, there is usually used a method of dissolving the resin into a solvent, mixing the solution with the core material particles, and then removing the solvent, or using mechanical impact force to fix the powder of the resin onto the core material particle surfaces.

When this method is used to form a coating resin layer from a thermoplastic resin having an alicyclic group, individuals of the alicyclic group in the coating resin layer are directed at random. In this case, the individuals of the alicyclic group have a larger skeleton than the main chain in the resin in many cases, and the individuals form fine and random irregularities in the resin surface. As a result, moieties of the resin which contact the core material particle surfaces at a molecular level are only convex portions of the resin. Thus, a resin skeleton slightly apart from the core material particle surfaces is generated in concave portions of the resin. However, van der Waals force acting onto the gap between the core material particle surfaces and the resin decreases largely even by only this slight distance. As a result, the adhesive force between the core material particles and the thermoplastic resin having the alicyclic group would decrease.

From this viewpoint, the following can be considered: when individuals of the alicyclic group, which has high hydrophobicity, are oriented to be directed toward the surface of the carrier (toward the atmosphere), the main chain skeleton side of the resin, which is not at the alicyclic group side of the resin, is directed to the surface of the core material so that the core material surface contacts moieties of the resin side which is not at the alicyclic group side. Consequently, at the resin side toward the core material particles, no fine irregularities based on the alicyclic group are not generated. Thus, the adhesive force between the two would be improved. In this case, it would be possible to obtain a carrier which less causes charge leakage and is excellent in environment stability.

In the meanwhile, the endothermic quantity of the carrier measured when the carrier is heated is related to the thermal motion of resin molecules in the coating resin layer. As the endothermic quantity is larger, molecules of the thermoplastic resin having the alicyclic group would be oriented at higher random.

Thus, the inventors have found out that: the orientation of the molecules of the thermoplastic resin having the alicyclic group depends on the endothermic quantity measured by the DTA method; and further it is necessary that the endothermic quantity of the whole of the carrier is set to 40 mJ/g or less in order to produce an advantageous effect that images can be formed stably over a long term by action of excellent environment stability of the carrier and the restraint of the peel of the coating resin layer from the core material, the action being caused by an improvement in the orientability of the molecules of the thermoplastic resin having the alicyclic group. This endothermic quantity is preferably 30 mJ/g or less, more preferably 25 mJ/g or less.

The method for controlling the endothermic quantity to 40 mJ/g or less is not particularly limited, and is in particular preferably a method of forming, on the surface of a core material surface, a coating resin layer comprising a thermoplastic resin having an alicyclic group by a method known in the conventional art, and then subjecting the resultant carrier to thermal treatment at a temperature not lower than the glass transition temperature of the thermoplastic resin having an alicyclic group.

This is based on the following reason: in the coating resin layer formed by the method known in the conventional art, molecules of the thermoplastic resin are oriented at random, as described above, and in the case of treating the carrier wherein the coating resin layer is formed thermally at a temperature not lower than the glass transition temperature of the thermoplastic resin having an alicyclic group, the molecules of the resin move freely so that the orientability of the resin molecules is improved. When the above-mentioned thermal treatment is conducted as described above after the formation of the coating resin layer, individuals of the alicyclic group, which has high hydrophobicity, are oriented to be directed toward the carrier surface (toward the atmosphere). Thus, the main chain side of the resin, which is not the alicyclic group side of the resin, would be oriented to the core material surface, which is hydrophilic.

When the glass transition temperature of the thermoplastic resin having an alicyclic group which is used to form a coating resin layer is 100° C. or lower, it is preferred to set the thermal treatment temperature into the range of the glass transition temperature or higher and 100° C. or lower. In this case, the above-mentioned orientated state can be made evener by water adsorbed on the core material particle surface.

For the above-mentioned reason, it is more preferred that the endothermic quantity is smaller. The endothermic quantity is most preferably 0 mJ/g. However, it is preferred from a practical viewpoint that the endothermic quantity is 7 mJ/g or more.

For the carrier of the invention, the thermal reduction in accordance with the TGA method is indispensably in the range of 0.5 weight % to 5 weight % of the whole of the carrier, preferably in the range of 2.0 weight % to 4.0 weight % thereof, and more preferably in the range of 2.5 weight % to 4.0 weight % thereof in the range of 100° C. to 400° C.

If the thermal reduction is less than 0.5 weight % of the whole of the carrier, the coating resin layer, which coats the core material surface, is too thin; therefore, the underlying layer of the coating resin layer produces an effect onto the charging characteristics of the carrier so that the dependency of the charging quantity onto environments may deteriorate or the carrier surface not coated with the coating resin layer may make its appearance easily. Thus, the charging quantity and the dependency onto environments may deteriorate. If the thermal reduction is more than 5 weight % of the whole of the carrier, the coating resin layer, which coats the core material surface, is too thick; therefore, particles of the carrier contact each other, inside a developing device or in stirring of the particles at the time of forming a magnetic brush. Thus, stress is gradually accumulated in the resin layer, which is relatively soft. Even if the stress is slight when the contact is performed only one time, this accumulated stress increases with the passage of time. Soon, the resin layer may peel off from the carrier.

In the invention, the thermal reduction and the endothermic quantity are each measured by the following method:

The thermal reduction is measured in accordance with JIS K 7120-1987 (Method for Measuring Thermal Weight of Plastic), the disclosure of which is incorporated by reference herein. Specifically, dry air is used as a gas, and this is caused to flow into the system at 50 mL/minute from one hour before the measurement. The weight of a test piece is 102 mg. The test piece is heated from 30° C. to 1,000° C. When the weight at 30° C. is represented by "a" and the weight at 400° C. is represented by b, the thermal reduction is obtained from the following expression:

$$\text{Thermal reduction (weight \%)}=100(a-b)/a$$

The endothermic quantity is measured by JIS K 7121-1987 (Testing Methods for Transition Temperature of Plastics), the disclosure of which is incorporated by reference herein. Specifically, dry air is used as a gas, and this is caused to flow into the system at 50 mL/minute from one hour before the measurement. The weight of a test piece is 102 mg. The test piece is heated from 30° C. to 1,000° C. A piece of alumina having a weight of 100 mg is used as a reference. For the measurements of the thermal reduction and the endothermic quantity, a device (trade name: TA-60WS) manufactured by Shimadzu Corp. and softwares attached thereto are used.

For the carrier of the invention, the peel amount of the coating resin layer is preferably 2,000 ppm or less, more preferably 1,500 or less.

If the peel amount of the coating resin layer is more than 2,000 ppm, images may not be formed stably over a long term with ease since the coating resin layer peels easily.

In the invention, the peel amount of the coating resin layer is measured by a method described below.

A carrier is precisely weighed into 40 g (up to the unit of mg) in a 100 mL beaker. Next, 40 mL of a 0.1% solution of a nonionic surfactant (trade name: HS-208, manufactured by Nippon Oil Co., Ltd.) in water is put into the beaker, and the beaker is heated to 38° C. An ultrasonic homogenizer (trade name: US-300TCVP-3, manufactured by Nissei Corp.) is used to apply ultrasonic waves thereto at "Level V (200 μA)" for 4 minutes. Thereafter, a magnet is attached to the bottom of the beaker, and the solution is transferred to a different beaker in such a manner that the carrier is not shifted to the different beaker. The following operation (1) is repeated 3 times:

(1) 40 mL of the aqueous solution of the nonionic surfactant is further put into a beaker in which a carrier is put; the solution is stirred with a glass rod for 3 minutes; and the solution is transferred into the different beaker.

A filter paper is precisely weighed up to the unit of mg. This is represented by X (mg). This filter paper is used to filtrate the 0.1% aqueous nonionic surfactant solution transferred to the different beaker to filtrate off impurities in the aqueous nonionic surfactant solution. The filter paper is put into a drier (50° C.), and is allowed to stand still as it is for 12 hours. After the 12 hours, the filter paper is taken out from the drier, and then cooled to 25° C. The weight of this filter paper is precisely weighed up to the unit of mg. This is represented by Y (mg).

The peel amount of the coating resin layer is obtained by the following expression:

$$\text{Peel amount (ppm) of the coating resin layer}=(Y-X)/\text{(the weight of the carrier)}$$

—Core Material—

The following will describe the constituents which constitute the carrier, and various other properties of the carrier.

The core material used in the carrier of the invention is not particularly limited, and may be any known core material for a carrier. Examples thereof include magnetic metals such as iron, steel, nickel, and cobalt; alloys each made of one or more of these metals and manganese, chromium, a rare earth metal or the like: and magnetic oxides such as ferrite and magnetite. The carrier is desirably a magnetic carrier in order to use a magnetic brush method. The core material used preferably in the invention is preferably made of ferrite particles since the surface is easily made uniform and the charge characteristics of the carrier become stable.

The core material is formed by granulation and sintering. The raw material thereof is preferably pulverized into fine particles in a pre-treatment. The method for the pulverization is not particularly limited, and may be in accordance with a known pulverizing method. A specific example thereof is a method using a mortar, a ball mill, or a jet mill. The final state of the pulverized particles in the pre-treatment is varied in accordance with the material and others. Preferably, the volume-average particle diameter is 2 μm to 10 μm. If the particle diameter is less than 2 μm, a desired final particle diameter may not be obtained. If the particle diameter is more than 10 μm, a final particle diameter becomes too large or the roundness may become small.

The sintering temperature is preferably made lower than that in the conventional art. Specifically, the temperature, which is varied in accordance with the use material, is preferably 500° C. or higher and 1,200° C. or lower, more preferably 600° C. to 1,000° C. If the sintering temperature is lower than 500° C., magnetic force for necessary as a carrier may not be obtained. If the temperature is higher than 1,200° C., the growth of the crystal is speedy so that the internal structure of the core material becomes uneven with ease. Thus, cracks are easily generated.

In order to make the sintering temperature low, it is preferred that pre-sintering is stepwise performed in the sintering step. It is therefore preferred to make the time for the whole of the sintering long.

The volume-average particle diameter of the core material is preferably 10 μm to 500 μm, more preferably 30 μm to 150 μm, and even more preferably 30 μm to 100 μm. If the volume-average particle diameter of the core material is less than 10 μm, in the use of the carrier in an electrostatic image developing developer the adhesive force between its toner and the carrier becomes high so that the developing amount of the toner may decrease. On the other hand, if the particle diameter is more than 500 μm, a rough magnetic brush is generated so that fine and minute images may not be formed with ease.

About the magnetic force of the core material in a magnetic field intensity of 3,000 oersteds, the saturation magnetization is preferably 50 emu/g or more, more preferably 60 emu/g or more. If the saturation magnetization is smaller than 50 emu/g, the carrier together with a toner may be developed on a photoreceptor.

The device used to measure the magnetic properties is a vibration sample type magnetism-measuring device (trade name: VSMP 10-15) manufactured by Toei Industry Co., Ltd. A sample to be measured is filled into a cell having an inside diameter of 7 mm and a height of 5 mm, and then the cell is set into the device. In the measurement, a magnetic field is applied to the sample, and sweeping up to a maximum value of 3,000 oersteds is performed. Next, the applied magnetic field is decreased to prepare a hysteresis curve on a recording paper. From data based on the curve, the saturation magnetization, the residual magnetization, and the coercivity are obtained. In the invention, the saturation magnetization is a magnetization measured in the magnetic field having an intensity of 3,000 oersteds.

The volume electric resistance (volume resistivity) of the core material is $10^5\Omega\cdot$cm to $10^{9.5}\Omega\cdot$cm, more preferably $10^7\Omega\cdot$cm to $10^9\Omega\cdot$cm. If the volume electric resistance is less than $10^5\Omega\cdot$cm, electric charges are injected to the carrier when the concentration of the toner in the developer is decreased by repeated copying, so that the carrier itself may be developed. On the other hand, if the volume electric resistance is more than $10^{9.5}\Omega\cdot$cm, a remarkable edge effect, a false contour or the like is caused so that a bad effect may be produced onto image quality.

The volume electric resistance ($\Omega\cdot$cm) of the core material is measured as described below. About environments for the measurement, the temperature is 20° C. and the humidity is 50% RH.

A sample to be measured is flatly put onto a surface of a circular tool wherein an electrode plate 20 $cm^2$ in area is arranged, so as to have a thickness of the sample of about 1 to 3 mm, thereby forming a layer. Thereon is put the same electrode plate as described above, 20 $cm^2$ in area, so as to sandwich the layer. In order to remove gaps between the sample and the electrodes, a load of 4 kg is applied to the electrode plate arranged on the layer and then the thickness (cm) of the layer is measured. An electrometer and a high-voltage power generating device are connected to the two electrodes on and beneath the layer. A high voltage is applied to the layer across the two electrodes so as to set the intensity of the electric field to $10^{3.8}$ V/cm. The current (A) flowing at this time is read out, and then the volume electric resistance ($\Omega\cdot$cm) of the sample is calculated. The equation for calculating the volume electric resistance ($\Omega\cdot$cm) of the sample is as represented by the following equation (1):

$$R=E\times 20/(I-I_0)/L \qquad \text{Equation (1)}$$

In the equation, R represents the volume electric resistance ($\Omega\cdot$cm) of the sample, E represents the applied voltage (V), I represents the current (A), $I_0$ represents the current (A) when the applied voltage is 0V, and L represents the thickness (cm) of the layer. The coefficient of 20 represents the area ($cm^2$) of each of the electrode plates.

—Coating Resin Layer—

As described above, the coating resin layer, which constitutes the carrier of the invention, comprises a "thermoplastic resin having an alicyclic group". The "thermoplastic resin having an alicyclic group" is not particularly limited as long as the group has an alicyclic group and thermal plasticity. Thus, the resin can be selected in accordance with the purpose. The "thermoplastic resin having an alicyclic group" may be a homopolymer made from a "monomer having the alicyclic group" or a copolymer made from a "monomer having the alicyclic group" and a "different monomer" as long as the resin obtained as a result of synthesis has thermal plasticity.

Specific examples of a monomer having an alicyclic group, as the above-mentioned "monomer having the alicyclic group", include alicyclic-group-containing acrylic monomers such as cyclopropyl acrylate, cyclobutyl acrylate, cyclopentyl acrylate, cyclohexyl acrylate, cyclopropyl methacrylate, cyclobutyl methacrylate, cyclopentyl methacrylate, cyclohexyl methacrylate, and derivatives thereof; monomers which can each constitute a norbornene resin; monomers which can each constitute a polycarbonate resin; monomers which can each constitute a polyester resin having an alicyclic group; cyclohexane dimethanol; cyclohexane dicarboxylic acid; and bisphenol Z. Of these examples, alicyclic-group-containing acrylic monomers are preferred, and cyclohexyl methacrylate is in particular preferred since the molecular structure thereof is stable.

Specific examples of the "different monomer" include nitrogen-containing acrylic monomers, such as dimethylaminoethyl methacrylate, methylaminoethyl methacrylate, dimethylaminobutyl methacrylate, other amino-group-containing acrylic monomers, and derivatives thereof; other acrylic monomers; monomers which can each constitute an olefin resin such as polyethylene or polypropylene; monomers which can each constitute a polyvinyl resin or polyvinylidene resin such as polystyrene resin, polyvinyl alcohol, polyvinyl butyral, polyvinyl chloride, polyvinyl carbazole, polyvinyl ether or polyvinyl ketone; monomers which can each constitute a straight silicone resin made of organosiloxane bonds, or a modified product thereof; monomers which can each constitute a fluorine-contained resin such as polytetrafluoroethylene, polyvinyl fluoride, polyvinylidene fluoride, or polychlorotrifluoroethylene; monomers which can each constitute a polyurethane resin, a phenol resin, a urea/formaldehyde resin (urea resin), a melamine resin, a benzoguanamine resin, and an amino resin such as a polyamide resin; monomers which can each constitute an epoxy resin; and other monomers which can each constitute a known resin. Of these examples, nitrogen-containing acrylic monomers are preferred since the carrier can hold electric charges with ease by action thereof. Of the monomers, amino-group-containing acrylic monomers are more preferred, and dimethylaminomethacrylate is even more preferred.

In the case of synthesizing a copolymer from the "monomer having an alicyclic group" with the "different monomer", the copolymerization ratio by mole is as follows: the ratio by mole of the "monomer having an alicyclic group" to the "different monomer" is preferably in the range of 20/80 to 80/20, more preferably in the range of 60/40 to 40/60.

If the ratio of the "monomer having an alicyclic group" to the "different monomer" is too large so as to be out of the above-mentioned range, the degree of the coating with the resin is deteriorated by the steric hindrance of individuals of the alicyclic group so that the resin may peel easily from the carrier surface. If the ratio is too small so as to be out of the above-mentioned range, the carrier may be poor in environment stability.

The coating resin may be a mixed resin composed of a polymer synthesized by use of the "monomer having an alicyclic group" (i.e., a resin synthesized by use of only the "monomer having an alicyclic group" and/or a copolymer made from the "monomer having an alicyclic group" and the "different monomer") and a resin synthesized without using the "monomer having an alicyclic group". In this case, the ratio of the resin synthesized by use of the "monomer having an alicyclic group" in the mixed resin is preferably 20 weight % or more, more preferably 30 weight % or more. As the ratio is nearer to 100 weight %, the ratio is more preferred. If the ratio of the resin synthesized by use of the "monomer having an alicyclic group" in the mixed resin is less than 20 weight %, the amount of the alicyclic group contained in the coating resin is too small. Thus, the hydrophobicity of the carrier surface lowers so that the dependency upon a change in environments such as temperature and humidity may become large.

The combination of the monomers in the copolymer is not particularly limited; a combination of cyclohexyl methacrylate and a nitrogen-containing acrylic monomer is preferred, and that of cyclohexyl methacrylate and dimethylaminoethyl methacrylate is more preferred. This combination can cause an improvement in the adhesive force of the coating resin layer onto the core material and an improvement in the charge characteristics without restraining the environment dependency. Additionally, the use of the above-mentioned specific core material can cause a further improvement in the environment dependency since the copolymer comprising, as monomer components, cyclohexyl methacrylate and the nitrogen-containing acrylic monomer can be caused not to enter the inside of the core material.

About the polymerization ratio between the cyclohexyl methacrylate and the nitrogen-containing acrylic monomer (in particular, dimethylaminoethyl methacrylate) in the copolymer therefrom, the content by percentage (the ratio by mole) of the nitrogen-containing acrylic monomer in all monomers used for the polymerization for the copolymer is 20% by mole to 80% by mole.

If necessary, the coating resin layer may contain electroconductive powder in order to control the resistance or attain some other purpose.

Specific examples of the electroconductive powder include particles of a metal such as gold, silver or copper; carbon black particles; ketchen black particles; acetylene black particles; particles of a semiconductive oxide having a volume resistivity of $10^8\Omega\cdot$cm to $10^{12}\Omega\cdot$cm, such as titanium oxide or zinc oxide; and particles wherein the surface of powder made of titanium oxide, zinc oxide, barium sulfate, aluminum borate, potassium titanate or the like is coated with tin oxide, carbon black, a metal, or the like.

These may be used alone or in combination of two or more thereof.

The electroconductive powder is preferably made of carbon black from the viewpoint of a good production stability, low costs and a good electroconductivity thereof.

The kind of the carbon black is not particularly limited, and carbon black having a DBP oil absorption of about 50 to 250 mL/100 g is preferred since the production stability is excellent.

The volume-average particle diameter of the electroconductive powder is preferably 0.5 μm or less, preferably 0.05 μm to 0.5 μm, and more preferably 0.05 μm to 0.35 μm. If the volume-average particle diameter is less than 0.05 μm, the aggregatability of the electroconductive powder is conversely deteriorated so that a difference is easily generated in volume resistance between the carrier particles. If the volume-average particle diameter is more than 0.5 μm, the electroconductive powder falls out easily from the coating resin layer so that stable charge characteristics may not be obtained.

The volume-average particle diameter of the electroconductive powder is measured by use of a laser diffraction type particle size distribution measuring device (trade name: LA-700, manufactured by Horiba Ltd.).

In a method for the measurement, 2 g of powder to be measured is added into 50 mL of a 5% solution of a surfactant, preferably sodium alkylbenzenesulfonate, in water and then the particles therein are dispersed with an ultrasonic disperser (1,000 Hz) for 2 minutes to prepare a sample.

The resultant volume-average particle diameters in individual channels are accumulated from the minimum out of the volume-average particle diameters. The value when a cumulative value of 50% is obtained is defined as the volume-average particle diameter.

The volume electric resistance of the electroconductive powder is preferably $10^1\Omega\cdot$cm to $10^{11}\Omega\cdot$cm, more preferably $10^3\Omega\cdot$Q cm to $10^9\Omega\cdot$cm.

The volume electric resistance of the electroconductive powder is measured in the same way for measuring the volume electric resistance of the core material.

The content by percentage of the electroconductive powder is preferably 0.05 mass to 1.5 mass % of the whole of the coating resin layer, more preferably 0.10 mass % to 1.0 mass %. If the content is more than 1.5 mass %, the resistance of the carrier decreases so that an image failure may be caused by the adhesion of the carrier onto a developed image, or the like. On the other hand, if the content is less than 0.05 mass %, the carrier is insulated. Thus, when a latent image is developed, the carrier does not work as a developing electrode. As a result, at the time of forming, in particular, a black solid image, an edge effect or the like is produced so that the reproducibility of the solid image may be poor.

The coating resin layer may further contain resin particles. Examples of the resin particles include thermoplastic resin particles and thermosetting resin particles. Of these examples, thermosetting resin particles are preferred since the hardness of the carrier can be made high with relative ease. In order to give a negative charge characteristic to the toner, resin particles made of a nitrogen-containing resin, which contains an N atom, are preferred. About the above-mentioned resin particles, only one species thereof may be used, or two or more species thereof may be used together.

For example, the volume-average particle diameter of the resin particles is preferably 0.1 μm to 2.0 μm, more preferably 0.2 μm to 1.0 μm. If the volume-average particle size of resin particles is less than 0.1 μm, the dispersibility of the resin particles in the coating resin layer may become very poor. On the other hand, if the particle diameter is more than 2.0 μm, the resin particles fall out easily from the coating resin layer so that the original effects of the carrier may not be exhibited.

The volume-average particle size of the resin particles can be obtained in the same way for measuring the volume-average particle size of the electroconductive powder.

The content by percentage of the resin particles is preferably 1 volume % to 50 volume % of the whole of the coating resin layer, more preferably 1 volume % to 30 volume % thereof, and even more preferably 1 volume % to 20 volume % thereof. If the content of the resin particles is less than 1 volume %, advantageous effects of the resin particles may not be exhibited. If the content is more than 50 volume %, the particles fall out easily from the coating resin layer so that a stable charge characteristic may not be obtained.

The method for forming the coating resin layer onto the core material surface is not particularly limited, and is, for example, a method of using a coating film forming solution wherein electroconductive powder, an alicyclic-group-containing acrylic resin, a polycarbonate resin and so on are contained in a solvent.

Specific examples thereof include an immersing method of immersing the core material into the coating film forming solution, a spray method of spraying the coating film forming solution onto the core material surface, and a kneader coater method of mixing the core material with the coating film forming solution in the state that the core material is floated by flowing air, and then removing the solvent. Of these examples, the kneader coater method is preferred.

The solvent used in the coating film forming solution is not particularly limited as long as the solvent can dissolve only the resin, and can be selected from known solvents. Specific examples thereof include aromatic hydrocarbons such as toluene and xylene; ketones such as acetone and methyl ethyl ketone; and ethers such as tetrahydrofuran and dioxane.

In the case that the resin particles are dispersed in the coating resin layer, the resin particles are evenly dispersed in the thickness direction thereof and the tangent direction of the carrier surface; therefore, even if the carrier is used for a long term so that the coating resin layer is worn down, the same surface as given when the carrier is not yet used can be kept. Thus, a good capability of charging a toner can be maintained for a long term.

In the case that the electroconductive powder is dispersed in the coating resin layer, the electroconductive powder is evenly dispersed in the thickness direction thereof and the tangent direction of the carrier surface; therefore, even if the carrier is used for a long term so that the coating resin layer is worn down, the same surface as given when the carrier is not yet used can be kept. Thus, a deterioration in the carrier can be prevented for a long term.

In the case that the resin particles and the electroconductive powder are dispersed in the coating resin layer, the above-mentioned advantageous effects can be simultaneously produced.

The coating resin layer may be a mono-layered structure or multi-layered structure.

The total content of the coating resin layer in the carrier of the invention is preferably in the range of 0.5 part by weight to 10 parts by weight, more preferably 1 part by weight to 5 parts by weight, and even more preferably 1 part by weight to 3 parts by weight for 100 parts by weight of the core material. If the content of the coating resin layer is less than 0.5 part by weight, the surface of core particles is largely exposed so that an electric field for development may readily be injected into the particles. If the content of the coating resin layer is more than 10 parts by weight, the resin powder is largely released from the coating resin layer. Thus, the peeling carrier resin powder may be incorporated into the developer from the initial stage.

The coating ratio of the core material surface with the coating resin layer is preferably 95% or more, more preferably 98% or more. As the ratio is nearer to 100%, the ratio is more preferred. If the coating ratio is less than 95%, charges are injected into the carrier when the developer is used for a long term. Thus, the carrier into which the charges are injected is shifted onto the photoreceptor so that white spots may be generated in the resultant images.

The coating ratio with the coating resin layer can be obtained by XPS measurement (X-ray photoelectron spectrometry). The device used for the XPS measurement is a device (trade name: JPS 80) manufactured by JEOL Ltd. In the measurement, a MgKα ray is used as the X-ray source. The acceleration voltage and the emission current are set to 10 kV and 20 mV, respectively. About the element which mainly constitutes the coating resin layer (usually, carbon), and the element which mainly constitutes the core material (iron and oxygen when the core material is an iron oxide based material such as magnetite), the amounts thereof are measured. A case in which the core material is an iron oxide based material will be described hereinafter. About carbon, iron and oxygen, the C1s spectrum thereof, the Fe2p3/2 spectrum, and the O1s spectrum are measured, respectively.

On the basis of the respective spectra of these elements, the number of the atoms of carbon, oxygen and iron ($A_C+A_O+A_{Fe}$) is obtained. The resultant number of the atoms is used to obtain the ratio of the iron amount in the core material alone and that of the iron amount in the core material coated with the coating resin layer (i.e., the carrier) by the following equation (2), and then the coating ratio is obtained by the following equation (3):

$$\text{Ratio of the ion amount (atomic \%)} = A_{Fe}/(A_C+A_O+A_{Fe})\times 100 \qquad \text{Equation (2)}$$

$$\text{Coating ratio (\%)} = \{1-(\text{the ratio of the iron amount in the carrier})/(\text{the ratio of the iron amount in the core material})\}\times 100 \qquad \text{Equation (3)}$$

In the case of using a material other than the iron oxide based material as the core material, the spectrum of the metal element which constitutes the core material is measured besides that of oxygen, and then substantially the similar calculation is made in accordance with the equations (2) and (3) to give the coating ratio.

The average film thickness of the coating resin layer is preferably 0.1 μm to 10 μm, more preferably 0.1 μm to 3.0 μm, and even more preferably 0.1 μm to 1.0 μm. If the average film thickness of the coating resin layer is smaller than 0.1 μm, the resistance is lowered by the peeling of the coating resin layer when the carrier is used for a long term. Alternatively, the pulverization of the carrier may not be controlled with ease. On the other hand, if the average film thickness is more than 10 μm, much time may be necessary until the charging quantity of the carrier reaches saturation.

The average film thickness (μm) of the coating resin layer can be obtained by the following equation (4), when ρ (dimensionless), d (μm), ρc, and Wc (parts by weight) represent the true specific gravity of the core material, the volume-average particle diameter of particles of the core material, the average specific gravity of the coating resin layer, and the total amount of the coating resin layer for 100 parts by weight of the core material, respectively:

$$\text{Average film thickness } (\mu m) = [\text{the amount of the coating resin (including the electroconductive powder and all other additives) per particle of the carrier/the surface area of each of the carrier particles}]/(\text{the average specific gravity of the coating resin layer}) = [4/3\pi\cdot(d/2)^3\cdot\rho\cdot Wc]/[4\pi\cdot(d/2)^2]/\rho c = (1/6)\cdot(d\cdot\rho\cdot Wc/\rho c) \qquad \text{Equation (4)}$$

<Characteristics of the Carrier>

The weight-average particle diameter of the carrier is preferably 15 μm to 50 μm, more preferably 25 μm to 40 μm. If the weight-average particle diameter of the carrier is less than 15 μm, contamination of the carrier may deteriorate. If the weight-average particle diameter is more than 50 μm, the toner may be remarkably deteriorated by stirring.

The weight-average particle diameter of the carrier is measured with a device (trade name: COULTER MULTISIZER II) manufactured by Beckman Coulter Co. The electrolytic solution used therein is a solution (trade name: ISOTON-II) manufactured by Beckman Coulter Co.

In the measurement, specifically, 0.5 to 50 mg of a sample to be measured is incorporated into 2 mL of a 5% solution of a surfactant, preferably sodium alkylbenzenesulfonate, as a dispersing agent in water. This is added to 100 to 150 mL of the electrolytic solution. This electrolytic solution wherein the sample is suspended is subjected to dispersing treatment with an ultrasonic disperser for one minute. In the COULTER MULTISIZER II, an aperture having an aperture diameter of 100 μm is used to measure the particle diameter distribution of particles having particle diameters in the range of 2.0 to 60 μm. The number of the particles to be measured is 50,000.

On the basis of the measured particle diameter distribution, a cumulative distribution of the weight is drawn from the side of the minimum diameter about divided particle diameter ranges (channels), and the value when a cumulative value of 50% is obtained is defined as the weight-average particle diameter.

The shape factor SF1 of the carrier is preferably 120 to 145 in order to make high image quality and high cleanable property of the carrier with each other.

The shape factor SF1 of the carrier is a value obtained by the following equation (5):

$$SF1=100\pi\times(ML)^2/(4\times A) \quad \text{Equation (5)}$$

wherein ML represents the maximum length of the carrier particles and A represents the projected area of the carrier particles. The maximum length of the carrier particles and the projected area of the carrier particles are those obtained by observing the carrier particles sampled on a slide glass with an optical microscope, taking an image thereof into an image analyzer (trade name: LUZEX III, manufactured by Nireco Co.) through a video camera, and then analyzing the image. The number of particles sampled at this time is 100 or more, and the average of results obtained therefrom is used to obtain the shape factor represented by the equation (5).

The saturation magnetization of the carrier is preferably 40 emu/g or more, more preferably 50 emu/g or more.

The device used to measure the magnetic properties is a vibration sample type magnetism-measuring device (trade name: VSMP 10-15) manufactured by Toei Industry Co., Ltd. A sample to be measured is filled into a cell having an inside diameter of 7 mm and a height of 5 mm, and then the cell is set into the device. In the measurement, a magnetic field is applied to the sample, and sweeping up to a maximum value of 1,000 oersteds is performed. Next, the applied magnetic field is decreased to prepare a hysteresis curve on a recording paper. From data based on the curve, the saturation magnetization, the residual magnetization, and the coercivity are obtained. In the invention, the saturation magnetization is a magnetization measured in the magnetic field having an intensity of 1,000 oersteds.

The volume electric resistance (volume resistivity) of the carrier is $1\times10^7\Omega\cdot$cm to $1\times10^{15}\Omega\cdot$cm, more preferably $1\times10^8\Omega\cdot$cm to $1\times10^{14}\Omega\cdot$cm, and even more preferably $1\times10^8\Omega\cdot$cm to $1\times10^{13}\Omega\cdot$cm.

If the volume electric resistance of the carrier is more than $1\times10^{15}\Omega\cdot$cm, the carrier comes to have a high resistance so that the carrier does not work as a developing electrode with ease in development. Thus, an edge effect is caused, particularly, in solid image areas. As a result, the reproducibility of solid images may lower. On the other hand, if the resistance is less than $1\times10^7\Omega\cdot$cm, the resistance of the carrier becomes low. Thus, when the concentration of the toner in the developer falls, charges are injected from the developing roll to the carrier so that an inconvenience that the carrier itself is developed may be caused with ease.

The volume electric resistance of the carrier is measured in the same way for measuring the volume electric resistance of the core material.

(Electrostatic Image Developing Developer)

The electrostatic image developing developer of the invention, which may be abbreviated to the "developer" hereinafter, comprises a toner and a carrier wherein the carrier is a carrier of the invention.

The toner is not particularly limited, and may be any known toner. A typical example of the toner is colored toner comprising a binder resin and a colorant. An infrared absorbing toner, wherein an infrared absorbent is used instead of the colorant, may be used. Besides these components, a releasing agent, various internal additives and external additives, and other components may be added thereto.

It is preferred that the developer of the invention comprises a particulate additive. The volume-average particle diameter of this additive is preferably 200 nm to 7 μm, more preferably 300 nm to 2 μm. The presence of this particulate additive originally causes the coating resin layer of the carrier to peel off with ease. However, in the developer of the invention, the peeling of the coating resin layer of the carrier is restrained since the carrier of the invention is used. Thus, high-quality images can stably be formed over a long term.

The particulate additive means a component other than the carrier and the toner (particulate bodies of the toner), and preferred examples thereof are inorganic oxide particles with which the toner particle surface is treated for external addition. Particularly preferred examples thereof are silica particles, cerium oxide particles or other inorganic oxide particles that have a volume-average particle diameter of 200 nm to 7 μm and are used as the so-called polishing agent.

The volume-average particle diameter of the particulate additive can be measured in the same way for measuring the volume-average particle diameter of the electroconductive powder.

The following will describe the toner used in the developer of the invention in more detail.

Examples of the binder resin of the toner are homopolymers or copolymers each made from one or more selected from monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Of these examples, particularly typical examples of the binder resin include polystyrene, styrene/alkyl acrylate copolymer, styrene/butadiene copolymer, styrene/maleic anhydride copolymer, polystyrene, and polypropylene. Other examples thereof include polyester, polyurethane, epoxy resin, silicone resin, polyamide, and modified rosin.

A crystalline binder resin may be used. An examples thereof is a polyester resin produced by condensing a dialcohol having, as its main chain, an alkyl chain wherein 6 or more methylene groups are linearly connected to each other, such as nonanediol, decanediol or dodecanediol and a dicarboxylic acid such as decanedioic acid, or dodecanedioic acid; or a resin having, as its polymerization unit, decyl acrylate, dodecyl acrylate or stearyl acrylate, which has, as its side chain, the above-mentioned alkyl group, wherein 6 or more methylene groups are linearly connected to each other.

The toner used in combination with the carrier of the invention is preferably a toner containing 5 weight % or more of the crystalline resin. This toner tends to have a low charging quantity at high temperature and high humidity. However, when the toner is used in combination with the carrier of the invention, the dependency of the charging quantity on environments can be made small.

The colorant is not particularly limited, and examples thereof include carbon black, aniline blue, chalcoyl blue, chromium yellow, ultramarine blue, Dupont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

If necessary, the toner may contain a charge controller. When a color toner is used as the toner in this case, it is preferred to use a colorless or light-color charge controller, which does not produce an effect onto the color tone of an image. Other examples of the charge controller are known ones. It is preferred to use an azo metal complex; a metal complex or metal salt of salicylic acid or an alkyl salicylate; or the like. The toner may also contain an offset inhibitor such as low molecular weight polypropylene, low molecular weight polyethylene or a releasing agent; or some other known component.

Examples of the releasing agent include paraffin wax and derivatives thereof; montan wax and derivatives; microcrystalline wax and derivatives; Fischer Tropsch wax and derivatives; and polyolefin wax and derivatives. Examples of the derivatives include oxides; polymers each made from any one of the waxes and a vinyl monomer; and graft modified products. Besides, the following can be used: an alcohol, an aliphatic acid, a plant wax, an animal wax, an ester wax, an acid amide, or the like.

Inorganic oxide particles may be added to the inside of the toner. Examples of the inorganic oxide particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$ particles. Of these examples, silica and titania particles are preferred. It is not necessarily essential that the surface of the oxide particles is subjected to treatment for hydrophobicity (i.e., hydrophobicity treatment) in advance; however, the surface may be subjected to hydrophobicity treatment. When the surface is subjected to hydrophobicity treatment, the dependency of the charging of the toner upon environments and the property of contaminating the carrier can be effectively restrained even if the inorganic particles inside the toner are partially exposed to the toner surface.

The hydrophobicity treatment can be conducted by immersing the inorganic oxide into an agent for hydrophobicity treatment. The agent for hydrophobicity treatment is not particularly limited, and examples thereof include silane coupling agents, silicone oil, titanate coupling agents, and aluminum-based coupling agents. These may be used alone or in combination of two or more thereof. Of these examples, silane coupling agents are preferred.

The silane coupling agents may be of any one of chlorosilane, alkoxysilane, silazane, and especial silylating agent types. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,N-(bistrimethylsilyl)acetoamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

The amount of the agent for hydrophobicity treatment cannot be specified without reservation since the amount is varied in accordance with the kind of the inorganic oxide particles, and other factors. Usually, the amount is preferably about from about 5 to 50 parts by weight for 100 parts by weight of the inorganic oxide particles.

Inorganic oxide particles may be added to the surface of the toner. Examples of the inorganic oxide particles, which can be added to the toner surface, include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$ particles. Of these examples, silica and titania particles are preferred. It is desired that the surface of the oxide particles is subjected to hydrophobicity treatment in advance. This hydrophobicity treatment makes it possible to improve the powdery fluidity of the toner and further restrain the dependency of the charging upon environments and the property of contaminating the carrier effectively.

In the same way as described above, the hydrophobicity treatment can be conducted by immersing the inorganic oxide into an agent for hydrophobicity treatment. The agent for hydrophobicity treatment is not particularly limited, and examples thereof include silane coupling agents, silicone oil, titanate coupling agents, and aluminum-based coupling agents. These may be used alone or in combination of two or more thereof. Of these examples, silane coupling agents are preferred.

The silane coupling agents may be of any one of chlorosilane, alkoxysilane, silazane, and especial silylating agent types. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,N-(bistrimethylsilyl)acetoamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

In the same manner as described above, the amount of the agent for hydrophobicity treatment cannot be specified without reservation since the amount is varied in accordance with the kind of the inorganic oxide particles, and other factors. Usually, the amount is preferably about from about 5 to 50 parts by weight for 100 parts by weight of the inorganic oxide particles.

About the particle diameter distribution of the toner, the number of the toner particles having a particle diameter of 4 μm or less is preferably from 6 to 25% of the total number of the toner particles, more preferably from 6 to 16% thereof. If the percentage of the number of the toner particles having a particle diameter of 4 μm or less is less than 6%, the number of particles contributing to the reproducibility of fine dots or the granularity is small. Furthermore, most of these particles have an effective particle diameter; therefore, the particles are selectively consumed. Thus, when copying is repeated, the toner particles having a particle diameter which does not contribute to development with ease unfavorably remain in the developing device. Accordingly, image quality may gradually deteriorate. On the other hand, if the percentage is more than 25%, the fluidity of the toner deteriorates so that the transportability of the developer may lower to produce a bad effect onto the developing property of the toner.

The percentage of the toner particles having a particle diameter of 16 μm or more is preferably 1.0 volume % or less. If the percentage is more than 1.0 volume %, a bad effect is produced onto the reproducibility of fine lines and the gradation of images. Furthermore, the coarse toner of 16 μm or more in size is interposed in the toner layer when the toner is transferred. Thus, the state of electrostatic adhesion between the electrostatic latent holding member and the transfer body is hindered, so that the efficiency of the transfer lowers, thereby resulting in a fall in the image quality.

The volume-average particle diameter of the toner is preferably from 5 to 9 μm. In order to reproduce a high image quality, it is desired that this range and the above-mentioned preferred range of the particle diameter distribution are compatible with each other. If the volume-average particle diameter is less than 5 μm, the fluidity of the toner deteriorates. Moreover, a sufficient charging capacity is not given from the carrier to the toner with ease so that fog may be generated in the background or the reproducibility of the image density may lower. If the volume-average particle diameter is more than 9 μm, the above-mentioned characteristics of the carrier cannot be sufficiently exhibited so that the effects of improving the reproducibility of fine dots, the graduation and the granularity may become poor.

Accordingly, when the toner has the above-mentioned toner particle diameter distribution and volume-average particle diameter, a high reproducibility can be expected about fines dots of latent images even in repeated copying of a manuscript having a large image area and a gradation in density, such as a photograph or a pamphlet.

The particle diameter distribution of the toner and the volume-average particle diameter thereof can be obtained in the same way for obtaining the volume-average particle diameter of the carrier. However, instead of drawing a cumulative distribution of the weight, on the basis of the measured particle diameter distribution, from the side of the minimum diameter about divided particle diameter ranges (channels), a cumulative distribution of the volume is drawn from the side of the minimum diameter. The value when a cumulative value of 50% is obtained is defined as the volume-average particle diameter.

The method for producing the toner may be a method which is ordinarily used, such as a kneading pulverization method or a wet granulation method. Examples of the wet granulation method include suspension polymerization, emulsion polymerization, emulsion polymerizing coagulation, soap-free emulsion polymerization, non-aqueous dispersion polymerization, in-situ polymerization, surface polymerization, emulsion dispersing granulation, and coagulation/coalescence methods.

In order to produce the toner by the kneading polymerization method, a binder resin, an optional colorant, and other additives are sufficiently mixed with a mixer such as a Henschel mixer or a ball mill. The mixture is melted and kneaded by use of a thermal kneader such as a heating roll, a kneader or an extruder, so as to make the resin and the other components compatible with each other. In the resultant, an infrared absorbent, an antioxidant and others are dispersed or dissolved, and then the dispersion or solution is cooled and solidified. The resultant is then pulverized and classified to yield the toner.

In the case of forming the toner particles by the wet granulation method, the shape factor of the toner particles is preferably in the range of 110 to 135.

The shape factor of the toner particles can be obtained in the same manner for obtaining the shape factor SF1 of the carrier.

About the blend ratio by weight between the toner and the carrier in the developer of the invention, the ratio by weight of the toner to the carrier is preferably 0.01 or more and 0.3 or less, more preferably 0.03 or more and 0.2 or less.

The developer of the invention can be used as a developer which is beforehand put into a toner image forming unit (developer-holding container), or a supplying developer used in, for example, a trickle developing manner.

About the blend ratio by weight between the toner and the carrier in the case of using the developer of the invention as the supplying developer, the ratio by weight of the toner to the carrier is preferably 2 or more, more preferably 3 or more, and even more preferably 5 or more.

(Electrostatic Image Developing Cartridge, Image Forming Apparatus, and Process Cartridge)

The following will describe the electrostatic image developing cartridge of the invention, which may be abbreviated to the "cartridge" hereinafter. The cartridge of the invention is a cartridge which can be put onto and taken off from an image forming apparatus comprising a toner image forming unit, and which can hold a developer that is to be supplied to the toner image forming unit, wherein the developer is a developer of the invention.

Accordingly, when the cartridge of the invention, in which the developer of the invention is put, is used in an image forming apparatus having a structure which a cartridge can be put onto or taken off from, the dependency of the developer upon environments is small and further the coating resin layer (of the carrier in the developer) does not peel easily. Thus, images can stably be formed for a long term.

In the case of using the cartridge of the invention, in particular, as a trickle developing type image forming apparatus, the cartridge may be a cartridge which can hold the developer of the invention or may be a combination of a cartridge which can hold only a toner and another cartridge which can hold only the carrier of the invention.

The type of the image forming apparatus of the invention is not particularly limited as long as the type is an electrophotographic type capable of using a two-component developer to form an image. Specifically, the image forming apparatus is preferably a device comprising an electrostatic latent image holding member, a charging unit for charging a surface of the electrostatic latent image holding member, an electrostatic latent image forming unit for forming an electrostatic latent image onto the charged surface of the electrostatic latent image holding member, a toner image forming unit for developing the electrostatic latent image with the developer to form a toner image, a transferring unit for transferring the toner image onto a surface of a recording medium, and a fixing unit for fixing the toner image transferred onto the surface of the recording medium. In the device, the electrostatic image developing developer of the invention is essentially used.

Accordingly, in the case of using the image forming apparatus of the invention, wherein the developer of the invention is used, the dependency of the developer upon environments is small and further the coating resin layer (of the carrier in the developer) does not peel easily. Thus, images can stably be formed for a long term.

The structure of the image forming apparatus of the invention is not particularly limited as long as the device comprises the above-mentioned electrostatic latent image holding member, charging unit, electrostatic latent image forming unit, toner image forming unit, transferring unit and fixing unit. If necessary, the structure may comprise a cleaning unit, an erasing unit, or the like.

The toner image forming unit may have a structure having a developer holding container for holding the developer of the invention, a developer supplying unit for supplying the developer to the developer holding container, and a developer discharging unit for discharging at least one part of the developer which the developer holding container holds, that is, a structure of a trickle developing type.

About the blend ratio by weight between the toner and the carrier in the developer for supplying the developer holding container (i.e., the supplying developer), the blend ratio by weight of the toner to the carrier is preferably 2 or more, more preferably 3 or more, and even more preferably 5 or more.

When a resin-coated carrier wherein a coating resin layer peels easily is used in the case of using a trickle developing manner, the coating resin layer in the developer which is originality present in a developing holding container peels. Besides, the coating resin layer in the developer supplied from a developer supplying unit to the developer holding container whenever necessary also peels. Thus, an effect based on peeling powder of the carrier resin becomes larger than in the case of not using any trickle developing manner.

However, in the case of using the image forming apparatus of the invention, wherein the developer of the invention is used, the coating resin layer in the developer of the invention does not peel easily. Thus, the above-mentioned problem is not caused easily even if a trickle developing manner is used.

Therefore, the environment dependency can be restrained, and images can stably be formed over a long term.

The process cartridge of the invention is removably mounted to an image forming apparatus, and comprises an electrostatic latent image holding member, and a toner image forming unit for holding a developer of the invention and further supplying the developer onto an electrostatic latent image formed on a surface of the electrostatic latent image holding member, thereby forming a toner image. The cartridge preferably comprises at least one selected from a charging unit, a cleaning unit, and an erasing unit.

Accordingly, when the process cartridge of the invention, which receives the developer of the invention, is used in an image forming apparatus having a structure to which a process cartridge is removably mounted, the dependency upon environmental factors such as temperature and humidity is small and the coating resin layer (of the carrier in the developer) does not peel off with ease. Thus, images can stably be formed for a long term.

The toner image forming unit constituting the image forming apparatus or the process cartridge of the invention usually comprises a developer holding member for supplying a developer onto a surface of an electrostatic latent image holding member, and this developer holding member is a cylindrical member for supplying the developer onto the surface of the electrostatic latent image holding member while the developer holding member is rotated.

The peripheral speed of the developer holding member at the time of supplying the developer is preferably 400 mm/s or more, more preferably 450 mm/s or more. In the image forming apparatus of the invention, or an image forming apparatus to which the process cartridge of the invention is fitted, images can be formed at a high speed in a high speed range that the peripheral speed of the developer holding member is 400 mm/s or more. However, a large mechanical stress is applied to the developer when an image is formed; thus, the coating resin layer may peel easily.

However, in the image forming apparatus or the process cartridge of the invention, the developer of the invention, wherein the peeling of the coating resin layer is not easily caused, is used; therefore, even if images can be formed at a high speed over a long term, the peeling of the coating resin layer can be restrained so that high-quality images can stably be formed over a long term.

The upper limit of the developer holding member is not particularly limited, and the limit is preferably 1,500 mm/s or less, more preferably 1,200 mm/s or less from the viewpoint of practical use.

With reference to the attached drawings, specific examples of the cartridge, the image forming apparatus and the process cartridge of the invention will be described hereinafter.

FIG. 1 is a sectional view which schematically illustrates a basic structure of a preferred embodiment (first embodiment) of the image forming apparatus of the invention. The image forming apparatus illustrated in FIG. 1 has a structure having an example of the cartridge of the invention.

The image forming apparatus 10 has an electrostatic latent image holding member 12, a charging unit 14, an electrostatic latent image forming unit 16, a toner image forming unit 18, a transferring unit 20, a cleaning unit 22, an erasing unit 24, a fixing unit 26, and a cartridge 28.

The developer put in the toner image forming unit 18 and the cartridge 28 is a developer of the invention.

For conveniences' sake, FIG. 1 illustrates only a structure having the single toner image forming unit 18 and the single cartridge 28, in each of which the developer of the invention is put; however, in the case of, for example, a color image forming apparatus, the device may have a structure having toner image forming units 18 and cartridges 28, the number of each of which corresponds to image formation.

The image forming apparatus 10 illustrated in FIG. 1 is an image forming apparatus having a structure which the cartridge 28 can be put onto and taken off from, and the cartridge 28 is connected through a developer supplying pipe 30 to the toner image forming unit 18. Thus, when an image is formed, the developer of the invention put in the cartridge 28 is supplied through the developer supplying pipe 30 to the toner image forming unit 18, whereby images can be made from the developer of the invention over a long term. When the amount of the developer put in the cartridge 28 becomes small, this cartridge 28 can be exchanged.

Around the electrostatic latent image holding member 12, the following are arranged in order along the rotation direction (the direction of an arrow A) of the electrostatic latent image holding member 12: the charging unit 14 for charging the surface of the electrostatic latent image holding member 12, the electrostatic latent image forming unit 16 for forming an electrostatic latent image on the surface of the electrostatic latent image holding member 12 in accordance with image data, the toner image forming unit 18 for supplying the developer of the invention onto the formed electrostatic latent image, the transferring unit 20, in a drum form, which contacts the surface of the electrostatic latent image holding member 12 and can be rotated in the direction of an arrow B so as to follow the rotation of the electrostatic latent image holding member 12 in the direction of an arrow A, the cleaning unit 22, which contacts the surface of the electrostatic latent image holding member 12, and the erasing unit 24 for removing charges from the surface of the electrostatic latent image holding member 12.

A recording medium 50, which is transported toward the direction of an arrow C by means of a transporting unit not illustrated from the side of the rear end of the arrow C, can be inserted and passed into a gap between the electrostatic latent image holding member 12 and the transferring unit 20. At the front end side of the arrow C of the electrostatic latent image holding member 12, the fixing unit 26, which has therein a heating source (not illustrated), is arranged, and a press contacting section 32 is formed in the fixing unit 26. The recording medium 50 passed into the gap between the electrostatic latent image holding member 12 and the transferring unit 20 can be inserted and passed into the press contacting section 32 in the direction of the arrow C.

The electrostatic latent image holding member 12 may be, for example, a photoreceptor or a dielectric recording body.

The photoreceptor may be, for example, a photoreceptor having a mono-layered or multi-layered structure. The material of the photoreceptor may be an inorganic photosensitive material such as selenium or amorphous silicon, or an organic photosensitive material.

The charging unit 14 may be a known unit, for example, a contact type charging device using an electroconductive or semiconductive roller, brush, film, rubber blade or the like, or a non-contact type charging device, such as a corotron charging device or scorotron charging device using corona discharge.

The electrostatic latent image forming unit 16 may be any unit that is known in the conventional art and makes it possible to form signals for forming a toner image at desired sites in a recording medium surface, for example, a light exposure unit. The light exposure unit may be a light exposure unit known in the conventional art, for example, a combination of a semiconductor laser with a scanning device, a laser scanning writing device made of an optical system, or an LED head. The laser scanning writing device or the LED head is preferred in order to realize a preferred embodiment for making an light exposure image having a high resolution.

The transferring unit 20 may be a unit known in the conventional art, and specific examples thereof include a unit wherein an electroconductive or semiconductive roller, brush, film, rubber blade or the like to which a voltage is applied is used to make an electric field between the electrostatic latent image holding member 12 and the recording medium 50 to transfer a toner image made of charged toner particles, and a unit wherein the rear face of the recording medium 50 is corona-charged with a corotron charging device or scorotron charging device using corona discharge, or some other device to transfer a toner image made of the charged toner particles.

The transferring unit 20 may be a secondary transferring unit. The secondary transferring unit, which is not illustrated, is a unit for transferring a toner image once onto an intermediate transfer body, and then transferring the toner image secondarily from the intermediate transferring body onto the recording medium 50.

The cleaning unit 22 may be, for example, a cleaning blade or a cleaning brush.

The erasing unit 24 may be, for example, a tungsten lamp, or an LED.

The fixing unit 26 may be, for example, a thermal fixing unit for fixing a toner image by heating and pressing based on a heating roll and a pressing roll, or an optical fixing unit for heating a toner image by radiation of light from a flash lamp or the like to fix the image.

It is preferred that the material which forms the roll surface of the heating roll, the pressing roll, or the like is, for example, a material excellent in releasability from the toner, such as silicone rubber or a fluorine-contained resin in order not to cause the toner to adhere to the surface. In this case, it is not desirable to apply a releasing liquid such as silicone oil onto both surfaces of the rolls. The releasing liquid is effective for making a fixation latitude wide. However, the liquid is shifted onto the recording medium wherein an image is to be fixed; therefore, the medium wherein an image is formed becomes sticky. Thus, there may arise a problem that a tape cannot be not stuck onto the medium or characters cannot be written on the medium with a color felt pen. This problem may become pronounced when an OHP film or the like is used as the recording medium. Moreover, the releasing liquid cannot make the roughness of the fixed image surface small with ease; therefore, the liquid may cause a decrease in image transparency, which is particularly important when an OHP film is used as the recording medium. However, in the case that the toner contains a wax (an offset inhibitor), a sufficient fixing latitude is exhibited; it is therefore unnecessary to use any releasing liquid to be applied onto the fixing roll, such as silicone oil.

The recording medium 50 is not particularly limited, and may be a medium known in the conventional art, such as plain paper or glossy paper. The recording medium may be a medium having a substrate and an image-holding layer formed on the substrate.

Next, the formation of an image by use of the image forming apparatus 10 will be described hereinafter. With the rotation of the electrostatic latent image holding member 12 in the direction of the arrow A, the surface of the electrostatic latent image holding member 12 is first charged by the charging unit 14. On the charged surface of the electrostatic latent image holding member 12, an electrostatic latent image corresponding to image data is formed by means of the electrostatic latent image forming unit 16. The developer P of the invention is supplied, in accordance with color data of the electrostatic latent image, from the toner image forming unit 18 to the surface of the electrostatic latent image holding member 12 on which the electrostatic latent image is formed, thereby forming a toner image.

Next, the toner image formed on the surface of the electrostatic latent image holding member 12 is shifted to the contact section of the electrostatic latent image holding member 12 and the transferring unit 20 with the rotation of the electrostatic latent image holding member 12 in the direction of the arrow A. At this time, the recording medium 50 is inserted and passed into the contact section in the direction of the arrow C by means of a sheet-transporting roll not illustrated. The toner image formed on the surface of the electrostatic latent image holding member 12 is transferred onto the surface of the recording medium 50 at the contact section by voltage applied between the electrostatic latent image holding member 12 and the transferring unit 20.

After the toner image is transferred to the transferring unit 20, the toner remaining on the surface of the electrostatic latent image holding member 12 is removed from the surface with a cleaning blade of the cleaning unit 22, and the charges on the surface are removed by the erasing unit 24.

The recording medium 50, onto the surface of which the toner image is transferred as described above, is transported to the press contacting section 32 of the fixing unit 26. When the medium 50 is passed into the press contacting section 32, the medium 50 is heated by the fixing unit 26 wherein the surface of the press contacting section 32 is heated by the heating source (not illustrated) inside the unit 26. At this time, the toner image is fixed onto the surface of the recording medium 50, thereby forming an image.

Figure 2:
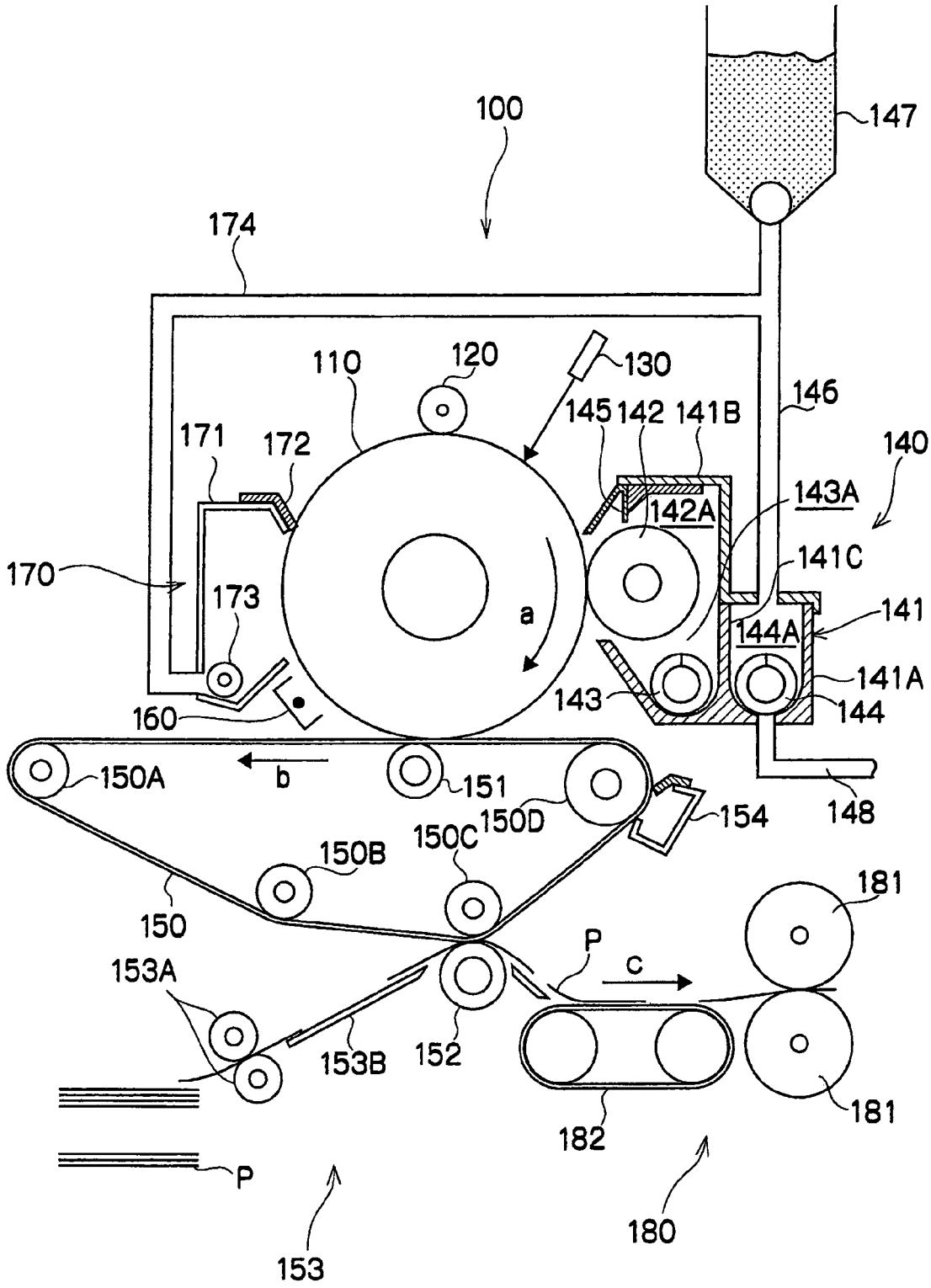
FIG. 2 is a sectional view which schematically illustrates another preferred embodiment (second embodiment) of the image forming apparatus of the invention.

FIG. 2 is a sectional view which schematically illustrates another preferred embodiment (second embodiment) of the image forming apparatus of the invention. The image forming apparatus illustrated in FIG. 2 has a structure wherein there is adopted a trickle developing manner of supplying a developer (supplying developer) of the invention into a developer holding container present inside a toner image forming unit from a developer supplying unit, and further discharging at least one part of the developer put in the developer holding container by a developer discharging unit.

As illustrated in FIG. 2, the image forming apparatus 100 has: an electrostatic latent image holding member 110 which can be clockwise rotated, as represented by an arrow a; a charging unit 120 which is arranged above the electrostatic latent image holding member 110 to face the electrostatic latent image holding member 110 and is a unit for charging the surface of the electrostatic latent image holding member 110 negatively; an electrostatic latent image forming unit 130 for writing an image to be made of the developer (toner) on the surface of the electrostatic latent image holding member 110 charged by the charging unit 120; a toner image forming unit 140 which is arranged at the downstream side of the electrostatic latent image forming unit 130 and is a unit for causing the toner to adhere onto the electrostatic latent image formed by the electrostatic latent image forming unit 130, so as to form a toner image on the surface of the electrostatic latent image holding member 110; an intermediate transfer belt 150, in an endless belt form, which is traveled in the direction represented by an arrow b while brought into contact with the electrostatic latent image holding member 110, and causes the toner image formed on the surface of the electrostatic latent image holding member 110 to be transferred; and an erasing unit 160 for removing charges on the surface of the electrostatic latent image holding member 110 after the toner image is transferred onto the intermediate transfer belt 150, thereby making it possible to remove easily the toner remaining on the surface after the transfer; and a cleaning unit 170 for cleaning the surface of the electrostatic latent image holding member 110 to remove the toner remaining after the transfer.

The charging unit 120, the electrostatic latent image forming unit 130, the toner image forming unit 140, the intermediate transfer belt 150, the erasing unit 160, and the cleaning unit 170 are arranged in a clockwise direction and on a circuit surrounding the electrostatic latent image holding member 110.

The intermediate transfer belt 150 is held and made strained from the inside thereof by means of tension rollers 150A and 150B, a backup roller 150C and a driving roller 150D, and further the belt 150 is driven in the direction of an arrow b with the rotation of the driving roller 150D. A primary transfer roller 151 is arranged inside the intermediate transfer belt 150 and at a position opposite to the electrostatic latent image holding member 110. The roller 151 is a roller for charging the intermediate transfer belt 150 positively to cause the toner on the electrostatic latent image holding member 110 to be adsorbed on the outside surface of the belt 150. A secondary transfer roller 152 is arranged below the outside of the intermediate transfer belt 150, so as to be made opposite to the backup roller 150C. The roller 152 is a roller for charging the recording medium P positively and pushing/pressing the medium P onto the intermediate transfer belt 150, thereby transferring the toner image formed on the belt 150 onto the recording medium P.

Furthermore, below the intermediate transfer belt 150 are arranged a recording medium supplying unit 153 for supplying the recording medium P to the secondary transfer roller 152, and a fixing unit 180 for fixing the toner image while transporting the recording medium P on which the toner image is formed through the secondary transfer roller 152.

The recording medium supplying unit 153 is provided with a pair of transporting rollers 153A, and an inducing slope 153B for inducing the recording medium P transported by the transporting roller 153A toward the secondary transfer roller 152. The fixing unit 180 has fixing rollers 181 which are a pair of heating rollers of heating and pressing the recording medium P onto which the toner image is transferred by the secondary transfer roller 152, thereby fixing the toner image, and a transporting conveyor 182 for transporting the recording medium P toward the fixing rollers 181.

The recording medium P is transported in the direction represented by an arrow c by means of the recording medium supplying unit 153, the secondary transfer roller 152 and the fixing unit 180.

An intermediate transfer cleaning unit 154 is arranged to face the driving roller 150D across the intermediate transfer belt 150. The intermediate transfer cleaning unit 154 has a cleaning blade for removing the toner remaining on the intermediate transfer belt 150 after the toner image is transferred onto the recording medium P by the secondary transfer roller 152.

The toner image forming unit 140 will be described in detail hereinafter. The toner image forming unit 140 is arranged to face the electrostatic latent image holding member 110 in the area for development, and has a developer holding container 141 for holding, for example, a two-component developer composed of a toner charged to a negative (−) polarity and a carrier charged to a positive (+) polarity. The developer holding container 141 has a developer holding container body 141A and a developer holding container coat 141B for coating the upper of the developer holding container body 141A.

The developer holding container body 141A has therein a developing roll room 142A for holding a developing roll 142 and has a first stirring room 143A adjacent to the developing roll room 142A and a second stirring room 144A adjacent to the first stirring room 143A. Inside the developing roll room 142A is arranged a layer thickness regulating member 145 for regulating the layer thickness of the developer on the surface of the developing roll 142 when the developer holding container coat 141B is fitted to the developer holding container body 141A.

The first and second stirring rooms 143A and 144A are partitioned with a partitioning wall 141C, and the first and second stirring rooms 143A and 144A are connected to each other at both ends of the partitioning wall 141C in the longitudinal direction thereof (the developing apparatus longitudinal direction), which is not illustrated. The first and second stirring rooms 143A and 144A constitute a circulating stirring room (143A+144A).

Inside the developing roll room 142A is arranged the developing roll 142 to face the electrostatic latent image holding member 110. The developing roll 142 is a member wherein a sleeve is fitted to the outside of a magnetic roll having magnetism (a fixed magnet), which is not illustrated. The developer in the first stirring room 143A is adsorbed onto the surface of the developing roll 142 by magnetic force of the magnetic roll, so as to be transported in the developing area. About the developing roll 142, its roll axis is supported by the developer holding container body 141A, so as to be freely rotatable. The developing roll 142 and the electrostatic latent image holding member 110 are rotated in reverse directions. At their opposite portions, the developer adsorbed on the surface of the developing roll 142 is transported in the developing area in the direction equal to the advancing direction of the electrostatic latent image holding member 110.

A bias power source not illustrated is connected to the sleeve of the developing roll 142, and a given developing bias can be applied thereto (in the present embodiment, a bias wherein direct current component (DC) and the alternative current components (AC) are overlapped is applied to the developing area in order to apply an alternating electric field to the developing area).

Inside the first and second stirring rooms 143A and 144A are arranged a first stirring member (stirring/transporting member) 143 and a second stirring member (stirring/transporting member) 144, respectively, for transporting the developer while stirring the developer. The first stirring member 143 is composed of a first rotary axis extending the axial direction of the developing roll 142 and stirring and transporting fans (projections) fixed spirally onto the outer circumference of the rotary axis. In the same manner, the second stirring member 144 is composed of a second rotary axis and stirring and transporting fans (projections). The stirring members are supported by the developer holding container body 141A, so as to be freely rotatable. The first and second stirring members 143 and 144 are arranged to transport the developers in the first and the second stirring rooms 143A and 144A in directions reverse to each other by rotation of the members 143 and 144.

To one of both ends of the second stirring room 144A in the longitudinal direction thereof is connected one end of the developer supplying unit 146 for supplying a supplying developer comprising a supplying toner and a supplying carrier to the second stirring room 144A. The other end of the developer supplying unit 146 is connected to a developer cartridge 147 in which a supplying developer is put. To one of both ends of the second stirring room 144A in the longitudinal direction thereof is also connected to one end of a developer discharging unit 148 for discharging the put developer. The other end of the developer discharging unit 148 is connected to a developer collecting container, which is not illustrated, for collecting the discharged developer.

As described above, the toner image forming unit 140 adopts the so-called trickle developing manner of supplying a supplying developer from the developer cartridge 147 through the developer supplying unit 146 to the toner image forming unit 140 (the second stirring room 144A), and discharging the developer that has been aged from the developer discharging unit 148 (i.e., a developing manner of making development while supplying a supplying developer [trickle developer] gradually and discharging the deteriorated developer generated to excess [the developer containing a large amount of the deteriorated carrier] in order to prevent a deterioration in the charge characteristics of the developer to prolong the interval between developer exchanges).

In the present embodiment, the structure using the developer cartridge 147 in which the supplying developer containing the carrier of the invention is put has been described as an example. However, the developer cartridge 147 may be a combination of a cartridge which can hold only a supplying toner and another cartridge which can hold only the carrier of the invention.

Next, the cleaning unit 170 will be described in detail hereinafter. The cleaning unit 170 comprises a housing 171, and a cleaning blade 172 arranged to be projected from the housing 171. The cleaning blade 172 is a plate-form member extending in the extending direction of the rotary axis of the electrostatic latent image holding member 110, and is arranged in such a manner that its tip portion, which will be referred to as the edge hereinafter, is pressed onto the electrostatic latent image holding member 110 to be brought into contact with the electrostatic latent image holding member 110 at the downstream side, along the rotary direction (the arrow a direction), of the position for transfer by the primary transfer roller 151 in the electrostatic latent image holding member 110 and at the downstream side, along the rotary direction, of the position for charge removal by the erasing unit 160.

The electrostatic latent image holding member 110 is rotated in the predetermined direction (the arrow "a" direction), thereby interrupting the toner remaining without being transferred, which is not transferred onto the recording medium P by the primary transfer roller 151 and adheres onto the electrostatic latent image holding member 110, paper powder of the recording medium P, and any other alien substance, and then removing these alien substance from the electrostatic latent image holding member 110.

On the inside bottom of the housing 171 is arranged a transporting member 173, and further to the downstream side of the housing 171 along the transporting direction of the transporting member 173 is connected one end of a supplying and transporting unit 174 for supplying the toner particles (developer) removed by the cleaning blade 172 to the toner image forming unit 140. The other end of the supplying and transporting unit 174 is jointed to the developer supplying unit 146.

As described above, the cleaning unit 170 adopts a toner reclaiming manner of transporting the toner particles remaining without being transferred through the supplying and transporting unit 174 to the toner image forming unit 140 (the second stirring room 144A) with the rotation of the transporting member 173 arranged on the bottom of the housing 171, and then stirring and transporting the toner together with the developer (toner) put therein, thereby reusing the toner particles.

Figure 3:
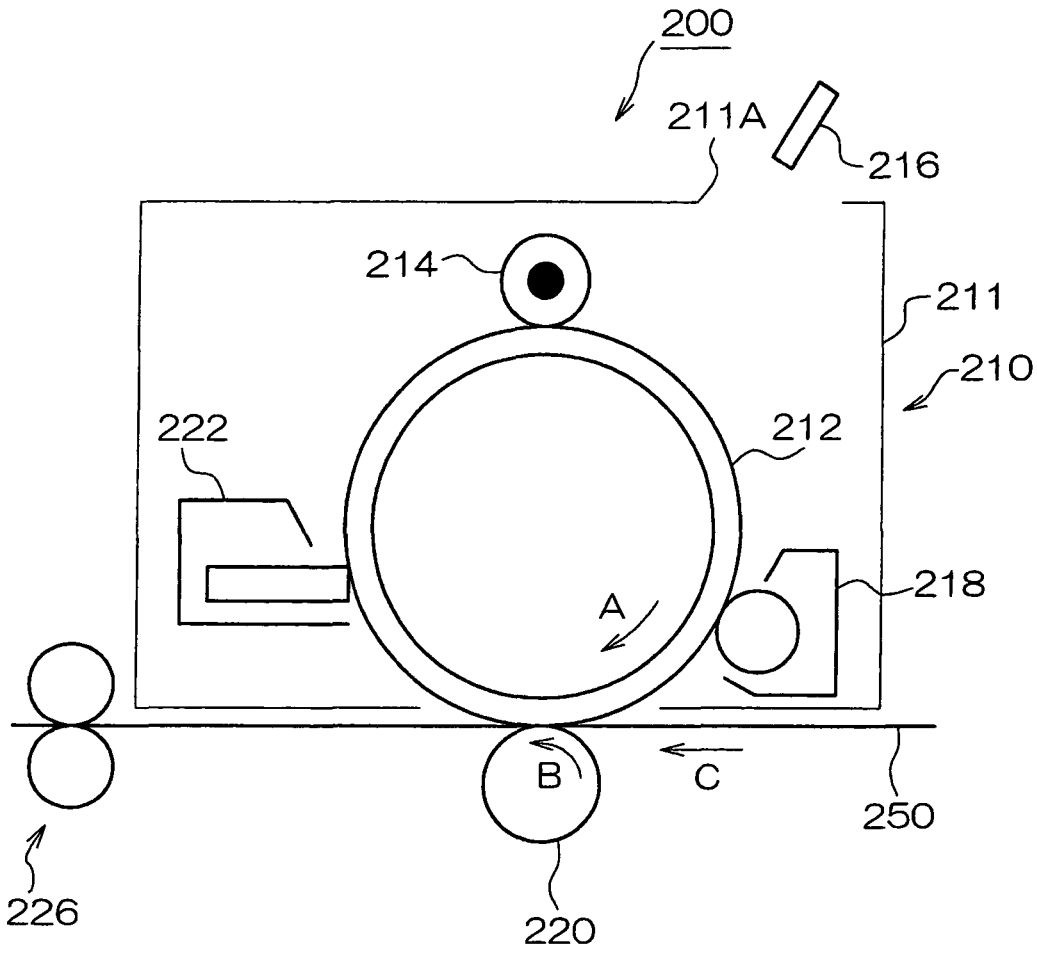
FIG. 3 is a sectional view which schematically illustrates still another preferred embodiment (third embodiment) of the image forming apparatus of the invention.

FIG. 3 is a sectional view which schematically illustrates a different preferred embodiment (third embodiment) of the image forming apparatus of the invention. The image forming apparatus 200 illustrated in FIG. 3 has a structure having a process cartridge of the invention.

The image forming apparatus 200 has a process cartridge 210 arranged to be put onto and taken off from an image forming apparatus body (not illustrated), an electrostatic latent image forming unit 216, a transferring unit 220, and a fixing unit 226.

The process cartridge 210 is a member wherein: an electrostatic latent image holding member 212 is set inside a housing 211 in which an opening 211A for forming an electrostatic latent image is made; and a charging unit 214, a toner image forming unit 218, and a cleaning unit 222 are set around the electrostatic latent image holding member 212, and are combined and integrated with each other through a rail (not illustrated). The process cartridge 210 is not limited to this form, and may be any member as long as the member comprises the toner image forming unit 218 and at least one selected from the electrostatic latent image holding member 212, the charging unit 214 and the cleaning unit 222.

The electrostatic latent image forming unit 216 is arranged at a position where an electrostatic latent image can be formed from the opening 211A in the housing 211 of the process cartridge 210 onto the electrostatic latent image holding member 212. The transferring unit 220 is arranged at a position which faces the electrostatic latent image holding member 212.

Details of the electrostatic latent image holding member 212, the charging unit 214 electrostatic latent image forming unit 216, the toner image forming unit 218, the transferring unit 220, the cleaning unit 222, the fixing unit 226, and a recording medium 250 are equivalent to the electrostatic latent image holding member 12, the charging unit 14, the electrostatic latent image forming unit 16, the toner image forming unit 18, the transferring unit 20, the cleaning unit 22, the fixing unit 26, and the recording medium 50, respectively, in the image forming apparatus 10 in FIG. 1.

The formation of an image by use of the image forming apparatus 200 in FIG. 3 is also equivalent to that by use of the image forming apparatus 10 in FIG. 1.

EXAMPLES

The invention will be described in more detail by the following examples; however, the invention is not limited to these examples. In the following description, the word "part(s)" means "a part or parts by weight".

—Production of Toner Particles a1—

| | |
|---|---|
| Polyester resin (a copolymer of a bisphenol A - 2-mole ethylene oxide adduct, cyclohexane dimethanol, and terephthalic acid (ratio by mole = 4/1/5); weight-average molecular weight Mw = 11,000) | 85 parts |
| Plant wax (carnauba wax) | 5 parts |
| $SiO_2$ particles (trade name: R972, manufactured by Nippon Aerosil Co., Ltd.) | 5 parts |
| C.I. Pigment Blue 15:3 | 5 parts |

A Henschel mixer is used to pre-mix the above-mentioned components sufficiently, and the resultant is melted and kneaded at 160° C. with a biaxial roll mill. The resultant is cooled, and then pulverized with a jet mill. The resultant powder is further classified two times with a wind energy classifier to produce (cyan) toner particles having a volume-average particle diameter of 6.5 μm. The number of the toner particles which have a particle diameter of 4 μm or less is 15% of the total number of the toner particles, and that of the toner particles which have a particle diameter of 16 μm or more is 0.7% thereof.

The Henschel mixer (3,000 rpm) is used to mix 100 parts of the toner particles with 1.5 parts of hydrophobic silicon oxide particles (trade name: RX200, manufactured by Nippon Aerosil Co., Ltd.; volume-average particle diameter=12 nm) as an external additive for 5 minutes, thereby preparing tone particles a1.

—Production of Toner Particles a2—

Toner particles a2 are prepared in the same way as in the production of the toner particles a1 except that 100 parts of the toner particles (cyan toner), 1.5 parts of hydrophobic silicon oxide particles (trade name: RX200, manufactured by Nippon Aerosil Co., Ltd.; volume-average particle diameter=12 nm) and 3 parts of cerium oxide (volume-average particle diameter=3.3 μm) as an external additive are used.

—Production of a carrier A1—

| | |
|---|---|
| Mn—Mg—Sr-ferrite particles (true specific gravity ρ: 4.6 g/cm$^3$, average particle diameter: 36.0 μm; and volume electric resistance: $10^8$ Ω · cm) | 100 parts |
| Toluene | 20 parts |
| Cyclohexyl methacrylate/dimethylaminoethyl copolymer resin (copolymerization ratio by mole of cyclohexyl methacrylate/dimethylaminoethyl: 99/1; weight-average molecular weight Mw: 9.8 × $10^4$; and glass transition temperature Tg: 90° C.) | 3 parts |

-continued

| | |
|---|---|
| Carbon black (trade name: VXC-72, manufactured by Cabot Co.) | 0.2 part |

Of the above-mentioned components, the cyclohexyl methacrylate/dimethylaminoethyl copolymer resin is diluted with toluene, and then carbon black is added thereto. The resultant is stirred with a homogenizer for 5 minutes to produce a resin solution.

Subsequently, this resin solution and the Mn—Mg—Sr-ferrite particles are put into a vacuum degassing type kneader, and the mixture is stirred at 80° C. for 30 minutes. Thereafter, the pressure is reduced to 100 Pa over 10 minutes while the temperature is kept at 80° C. In this way, toluene is removed to form a coating film on the surface of the ferrite particles. Thereafter, the resultant is again put into the kneader, and then stirred at 95° C. and the atmospheric pressure for 30 minutes. The heating of the kneader is then stopped, and the resultant is taken out when the temperature turns to 70° C. The taken-out product is classified with a sieve having openings having a diameter of 75 μm, so as to yield a carrier A1.

—Production of a Carrier A2—

A carrier A2 is yielded in the same way as in the production of the carrier A1 except that the time for the stirring at the atmospheric pressure is changed from 30 minutes to 45 minutes, and further the temperature of the system is lowered to 70° C. at 3° C./minute.

—Production of a Carrier A3—

A carrier A3 is yielded in the same way as in the production of the carrier A1 except that the time for reducing the pressure to 100 Pa while the temperature is kept at 80° C. after the mixture is stirred at 80° C. is changed from 10 minutes to 30 minutes.

—Production of a Carrier A4—

A carrier A4 is yielded in the same way as in the production of the carrier A2 except that the time for stirring the mixture with the homogenizer after the cyclohexyl methacrylate/dimethylaminoethyl copolymer resin is diluted with toluene and then carbon black is added thereto is changed from 5 minutes to 20 minutes.

—Production of a Carrier A5—

A carrier A5 is yielded in the same way as in the production of the carrier A2 except that the time for stirring the mixture with the homogenizer after the cyclohexyl methacrylate/dimethylaminoethyl copolymer resin is diluted with toluene and then carbon black is added thereto is changed from 5 minutes to 40 minutes.

—Production of a Carrier B1—

A carrier B1 is yielded in the same way as in the production of the carrier A1 except that the following treatment is not conducted: the treatment of forming the coating film on the surface of the ferrite particles, putting the resultant again into the kneader and then stirring the resultant at the atmospheric pressure for 30 minutes.

—Production of a Carrier B2—

A carrier B2 is yielded in the same way as in the production of the carrier A1 except that the time for stirring the mixture with the homogenizer after the cyclohexyl methacrylate/dimethylaminoethyl copolymer resin is diluted with toluene and then carbon black is added thereto is changed from 5 minutes to 2 minutes.

—Production of a Carrier B3—

| | |
|---|---|
| Mn—Mg—Sr-ferrite particles (true specific gravity ρ: 4.6 g/cm$^3$, average particle diameter: 36.0 μm; and volume electric resistance: $10^8$ Ω · cm) | 100 parts |
| Toluene | 20 parts |
| Styrene/methyl methacrylate copolymer resin (the copolymerization ratio by mole of styrene/methyl methacrylate: 18/82; weight-average molecular weight Mw: 8.1 × $10^4$; and glass transition temperature Tg: 109° C.) | 3 parts |
| Carbon black (trade name: VXC-72, manufactured by Cabot Co.) | 0.2 parts |

Of the above-mentioned components, the styrene/methyl methacrylate copolymer resin is diluted with toluene, and then carbon black is added thereto. The resultant is stirred with a homogenizer for 5 minutes to produce a resin solution. Subsequently, this resin solution and the Mn—Mg—Sr-ferrite particles are put into a vacuum degassing type kneader, and the mixture is stirred at 80° C. for 10 minutes. Thereafter, the pressure is reduced to 100 Pa over 5 minutes while the temperature is kept at 80° C. In this way, toluene is removed to form a coating film on the surface of the ferrite particles. Thereafter, the taken-out product is classified with a sieve having openings having a diameter of 75 μm, so as to yield a carrier B3.

[Production of Developers]

From the carries produced as described above and the toners produced as described above, each combination shown in Table 1 is selected, and 93 parts by weight of the carrier in the combination and 7 parts by weight of the toner therein are mixed to yield a developer.

Moreover, in accordance with each combination shown in Table 1, 80 parts by weight of the toner and 20 parts by weight of the carrier are put into an empty cartridge for an electrophotographic printer (trade name: DocuCentre Color a450, manufactured by Fuji Xerox Co., Ltd.). The cartridge is coated with a lid, and then the cartridge is shaken 10 minutes by hand, so as to yield a supplying developer.

[Evaluating Methods]

These developers and supplying developers are each used, and the developing performance and the property about fog thereof are evaluated at high temperature and high humidity (at 30° C. and 80% RH) and at low temperature and low humidity (at 10° C. and 10% RH) by methods described below, using an electrophotographic copying machine obtained by remodeling a machine (trade name: DocuCentre Color 400CP, manufactured by Fuji Xerox Co., Ltd.) in such a manner that the speed of its developer holding member can be varied to 50 mm/s and 500 mm/s.

<Evaluation of Developing Performance and Property about Fog Density>

Paper sheets each having an A3 size (trade name: J paper, manufactured by Fuji Xerox Office Supply) are used. Images, each of which is the very same, are continuously outputted onto 10,000 out of the papers so as to output a solid image having a density of 4.5 g/m$^2$ onto the first half of each of the sheets passing inside the copying machine and output no image onto the second half thereof. About the developing performance, the state of the 10,000$^{th}$ paper sheet is evaluated with the naked eye, using the first paper sheet as a reference. About the property about fog, the first paper sheet and the 10,000$^{th}$ paper sheet are evaluated with the naked eye in accordance with a criterion described below.

About copying machines in offices or the like, the most popular use embodiment thereof would be an embodiment wherein an image composed of characters is formed on an A4 paper sheet.

On the other hand, the present evaluation is made under conditions that the consumption amount of a toner is larger to impose a larger burden onto the function of stabilizing the charging quantity of the toner by action of a carrier (conditions for forming not any charter image but a solid image, wherein the image area ratio is maximum, onto the first half of an A3 paper sheet having a larger area than any A4 paper sheet) than under conditions in the above-mentioned popular use embodiment. The reason therefor is that difference in performances between carriers can be most clearly checked, as described below.

A carrier in a developing unit is mixed with a toner, whereby the carrier has a function of stabilizing the charging quantity of the toner to be supplied to an electrostatic latent image holding member into a predetermined range. However, as the amount of the toner consumed per unit time is larger, the toner is less mixed with the carrier in the developing unit, and then the toner and the carrier are supplied onto the electrostatic latent image holding member.

Therefore, in the case (1) that the toner amount consumed per unit time is small, the following is caused: even if the above-mentioned function is maintained in the state that the carrier is deteriorated, the above-mentioned function cannot be sufficiently exhibited in the case (2) that the toner amount consumed per unit time becomes large in the state that the carrier is deteriorated to the same degree.

Therefore, when images are continuously formed, the charging quantity of the toner falls with time in the case (2) so that the generation of fog is observed even if no apparent change is observed with time in the case (1).

<Evaluation Criterion of Developing Performance>

G1: A fall in the image density in the solid image portion cannot be observed.

G2: A fall in the image density in the solid image portion can be observed, but no practical problem is caused.

G3: A fall in the image density in the solid image portion can be observed, but the fall is permissible.

G4: A fall in the density can be evidently observed.

<Evaluation Criterion of Property about Fog Density>

G1: No fog is observed with the naked eye.

G2: Fog is observed with a loupe, but no problem is caused.

G3: Fog is observed, but the fog is permissible.

G4: Fog is evidently observed.

The results are shown in Table 1.

TABLE 1

| | | | | Example 1 | Example 2 | Example 3 | Example 4 | Example 5 | Example 6 | Comparative example 1 | Comparative example 2 | Comparative example 3 |
|---|---|---|---|---|---|---|---|---|---|---|---|---|
| Developer and Supplying Developer | Toner | | Kind | a1 | a1 | a1 | a1 | a2 | a1 | a1 | a1 | a1 |
| | Carrier | | Kind | A1 | A2 | A3 | A4 | A5 | A5 | B1 | B2 | B3 |
| | | Alicyclic group of coating resin | | Present | Present | Present | Present | Present | Present | Present | Present | Absent |
| | | Various properties | Endothermic quantity (mJ/g) | 26 | 14 | 24 | 11 | 10 | 10 | 56 | 20 | 66 |
| | | | Thermal reduction (%) | 4.1 | 3.6 | 1.1 | 2.1 | 1.8 | 1.8 | 4.2 | 5.8 | 5.2 |
| | | | Peel amount of coating resin layer (ppm) | 2600 | 1800 | 600 | 1200 | 900 | 900 | 2700 | 3100 | 3300 |
| | Particulate additive (particle diameter: 200 nm to 7 μm) | | | Not added | Not added | Not added | Not added | Added | Not added | Not added | Not added | Not added |
| | Peripheral speed of developing holding member (mm/s) | | | 350 | 350 | 350 | 350 | 350 | 500 | 350 | 350 | 350 |
| Evaluation | High temperature and high humidity environment (30° C., 80% RH) | Initial properties | Fog Density | G1 | G1 | G1 | G1 | G1 | G1 | G2 | G2 | G2 |
| | | After output of 10000 paper sheets | Developing performance | G2 | G2 | G2 | G1 | G1 | G1 | G2 | G2 | G2 |
| | | | Fog Density | G3 | G2 | G2 | G2 | G1 | G1 | G3 | G4 | G4 |
| | Low temperature and low humidity environment (10° C., 10% RH) | Initial properties | Fog Density | G1 | G1 | G1 | G1 | G1 | G1 | G2 | G3 | G2 |
| | | After output of 10000 paper sheets | Developing performance | G3 | G1 | G2 | G1 | G1 | G1 | G3 | G3 | G4 |
| | | | Fog Density | G2 | G2 | G2 | G2 | G1 | G2 | G4 | G2 | G2 |

What is claimed is:

1. An electrostatic image developing carrier comprising at least a core material and a coating resin layer which coats the surface of the core material, wherein the resin layer comprises a thermoplastic resin having an alicyclic group, a thermal reduction of the carrier in accordance with the TGA method is in the range of 0.5 weight % to 5 weight % of the whole of the carrier in the range of 100° C. to 400° C., and further an endothermic quantity of the whole of the carrier in accordance with the DTA method is in the range of 7 mJ/g to 40 mJ/g in the range of 100° C. to 400° C., and the thermoplastic resin having the alicyclic group is a copolymer made from a monomer having the alicyclic group and a nitrogen-containing acrylic monomer, and the alicyclic group of the thermoplastic resin is oriented away from the surface of the core material.

2. The electrostatic image developing carrier of claim 1, wherein the endothermic quantity is in the range of 7 mJ/g to 30 mJ/g.

3. The electrostatic image developing carrier of claim 1, wherein the thermal reduction is in the range of 2.0 weight % to 4.0 weight % of the whole of the carrier.

4. The electrostatic image developing carrier of claim 1, wherein a peel amount of the coating resin layer is 2,000 ppm or less.

5. The electrostatic image developing carrier of claim 4, wherein the peel amount of the coating resin layer is 1,500 ppm or less.

6. The electrostatic image developing carrier of claim 1, obtained by forming the coating resin layer comprising a thermoplastic resin having the alicyclic group on the surface of the core material, and then subjecting the resultant to thermal treatment at a temperature not lower than the glass transition temperature of the thermoplastic resin having the alicyclic group.

7. The electrostatic image developing carrier of claim 6, wherein, in the case that the glass transition temperature of the thermoplastic resin having the alicyclic group is 100° C. or lower, the temperature for the thermal treatment is set to a temperature which is the glass transition temperature or higher and is 100° C. or lower.

8. The electrostatic image developing carrier of claim 1, wherein the monomer having the alicyclic group is an acrylic monomer having the alicyclic group.

9. The electrostatic image developing carrier of claim 1, wherein the coating resin layer comprises electroconductive powder.

10. An electrostatic image developing developer comprising a toner and a carrier, the carrier being the electrostatic image developing carrier of claim 1.

11. The electrostatic image developing developer of claim 10, further comprising a particulate additive, the volume-average particle diameter of the additive being in the range of 200 nm to 7 μm.

12. The electrostatic image developing carrier of claim 9, wherein the electroconductive powder is made of carbon black.

13. The electrostatic image developing carrier of claim 1, wherein after the surface of the core material is coated with the coating resin layer comprising a thermoplastic resin having an alicyclic group, the resultant carrier is subjected to thermal treatment at a temperature not lower than the glass transition temperature of the thermoplastic resin having the alicyclic group.

* * * * *